US005667752A

United States Patent [19]

Suzuki et al.

[11] Patent Number: 5,667,752

[45] Date of Patent: Sep. 16, 1997

[54] COPPER ALLOY SHEET FOR CONNECTORS AND CONNECTORS FORMED OF SAME

[75] Inventors: Takeshi Suzuki; Rensei Futatsuka; Manpei Kuwahara, all of Aizuwakamatsu; Seiji Kumagai, Tokyo, all of Japan

[73] Assignee: Mitsubishi Shindoh Co., Ltd., Tokyo, Japan

[21] Appl. No.: 618,829

[22] Filed: Mar. 20, 1996

[30] Foreign Application Priority Data

Dec. 1, 1995 [JP] Japan ..... 7-314029

[51] Int. Cl.[6] ..... C22C 9/00

[52] U.S. Cl. ..... 420/494; 420/449; 148/432

[58] Field of Search ..... 420/494, 499; 148/432

[56] References Cited

U.S. PATENT DOCUMENTS 4,859,417 8/1989 Innocenti ..... 420/493

FOREIGN PATENT DOCUMENTS 59-222543 12/1984 Japan ..... 420/494
1-54420 11/1989 Japan .
4-358033 12/1992 Japan .
5-59467 3/1993 Japan .

OTHER PUBLICATIONS

Suzuki, Takeshi; Kumagai, Seishi; and Kuwabara, Manhei, "Characteristics of high electrical conductivity spring alloy MSPI"; Shindo Gijutsu Kenkyu Kaishi (1988), 27 (abstract only).

*Primary Examiner*—Sikyin Ip
*Attorney, Agent, or Firm*—Frishauf, Holtz, Goodman, Langer & Chick, P.C.

[57] ABSTRACT

There is provided a copper alloy sheet for forming a connector, having a chemical composition consisting essentially of:

Mg: 0.3–2% by weight;
P: 0.001–0.02% by weight;
C: 0.0002–0.0013% by weight;
O: 0.0002–0.001% by weight; and Cu and inevitable impurities: the balance. The copper alloy sheet has a structure that fine particles of oxides including Mg oxide having a particle size of not more than 3 μm are evenly dispersed in a matrix of the copper alloy sheet. The copper alloy sheet is excellent not only in tensile strength, elongation, electric conductivity and spring limit value before forming, but also in spring limit value after forming, and high-temperature creep strength.

4 Claims, 1 Drawing Sheet

COPPER ALLOY SHEET FOR CONNECTORS AND CONNECTORS FORMED OF SAME

BACKGROUND OF THE INVENTION

1. Field of the Invention

This invention relates to a copper alloy sheet for connectors, which is excellent not only in tensile strength, elongation, electric conductivity and spring limit value but also in spring limit value after forming and high-temperature creep strength, and also relates to a connector formed of the same.

2. Prior Art

Generally, connectors are manufactured by cutting copper alloy sheets into strips, and then subjecting the strips to metal working such as pressing, blanking, and bending. During the manufacture, it is usually carried out to plate or galvanize the strips before the metal working or semi-finished products after the final working.

Among copper alloy sheets for forming connectors, there is known a copper alloy sheet, for example, from Japanese Patent Publication (Kokoku) No. 1-54420, which has a chemical composition consisting essentially of 0.3 to 2 percent by weight (hereinafter referred to as "%") Mg, 0.001 to 0.1% P, and the balance of Cu and inevitable impurities. It is also known that connectors formed of this known copper alloy sheet are excellent in tensile strength, electric conductivity, spring limit value, high-temperature creep strength, etc.

Recently, there have been developed connectors which are more miniaturized, lighter in weight, and closer in tolerances. Further, connectors are used even under high temperature and vibrational conditions, such as a location in the vicinity of an engine installed in an automotive vehicle. However, if the conventional connectors which are more miniaturized, lighter in weight, and closer in tolerances are used under such high temperature and vibrational conditions such as a location in the vicinity of an engine of an automotive vehicle, a connector formed of a material having a low spring limit value and hence low connecting strength can be disconnected from its counterpart due to vibrations of the engine, etc.

The present inventors have investigated the cause of troubles caused by conventional connectors when they are used under such high temperature and vibrational conditions, and reached the following finding:

In connectors formed of the conventional copper alloy sheet having the aforementioned chemical composition consisting essentially of 0.3 to 2% Mg, 0.001 to 0.1% P, and the balance of Cu and inevitable impurities, particles of oxides including Mg oxide dispersed in the matrix of the copper alloy have grown to larger particle sizes than 3 μm, which causes decrease of the spring limit value of the connector if it has been produced by bending, and also causes degradation of the high-temperature creep strength under a high temperature environment (150° C. or higher), which can result in a trouble as mentioned above.

SUMMARY OF THE INVENTION

It is a first object of the invention to provide a copper alloy sheet for connectors, which is excellent not only in tensile strength, elongation, electric conductivity and spring limit value but also in spring limit value after forming and high-temperature creep strength and possesses such a property that a blanking die used to blank the sheet has a lesser amount of wear after blanking.

It is a second object of the invention to provide a connector formed of a copper alloy sheet of the preceding object.

To attain the first object, the present invention provides a copper alloy sheet for connectors, having a chemical composition consisting essentially of:

Mg: 0.3–2% by weight;

P: 0.001–0.02% by weight;

C: 0.0002–0.0013% by weight;

O: 0.0002–0.001% by weight; and

Cu and inevitable impurities: the balance;

the copper alloy sheet having a structure that fine particles of oxides including Mg oxide having a particle size of not more than 3 μm are evenly dispersed in a matrix of the copper alloy sheet.

Preferably, the copper alloy sheet has a chemical composition consisting essentially of:

Mg: 0.3–1.2% by weight;

P: 0.003–0.012% by weight;

C: 0.0003–0.0010% by weight;

O: 0.0003–0.0008% by weight; and

Cu and inevitable impurities: the balance.

To attain the second object, the present invention provides a connector formed of a copper alloy sheet having a chemical composition consisting essentially of:

Mg: 0.3–2% by weight;

P: 0.001–0.02% by weight;

C: 0.0002–0.0013% by weight;

O: 0.0002–0.001% by weight; and

Cu and inevitable impurities: the balance;

the copper alloy sheet having a structure that fine particles of oxides including Mg oxide having a particle size of not more than 3 μm are evenly dispersed in a matrix of the copper alloy sheet.

Preferably, the copper alloy sheet of the connector has a chemical composition consisting essentially of:

Mg: 0.3–1.2% by weight;

P: 0.003–0.012% by weight;

C: 0.0003–0.0010% by weight;

O: 0.0003–0.0008% by weight; and

Cu and inevitable impurities: the balance.

The above and other objects, features and advantages of the invention will be more apparent from the following detailed description taken in conjunction with the accompanying drawings.

DETAILED DESCRIPTION

Figure 1:
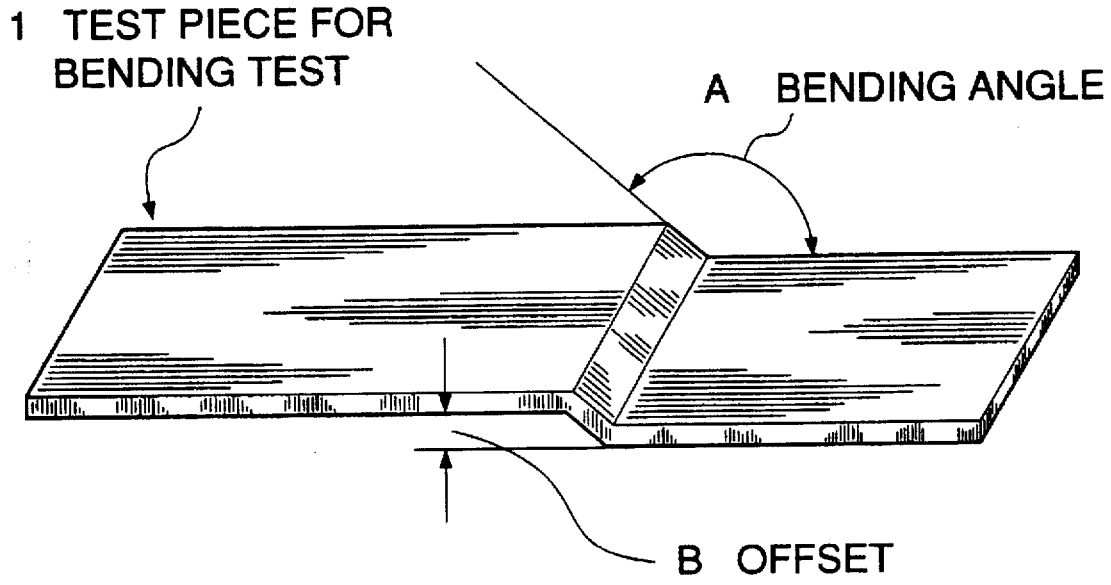
FIG. 1 is a perspective view showing a test piece for a bending test.

Under the aforestated circumstances, the present inventors have made studies in order to obtain a connector which is never disconnected from its counterpart even under high temperature and vibrational conditions, such as a location in the vicinity of an engine of an automotive vehicle, and have reached the following finding:

If in the conventional copper alloy sheet having a chemical composition consisting essentially of 0.3 to 2% Mg, 0.001 to 0.1% P, and the balance of Cu and inevitable impurities, the P content is limited to a range from 0.001 to 0.02%, and further the oxygen content is adjusted to a range from 0.0002 to 0.001%, and the carbon content to a range from 0.0002 to 0.0013% so that particles of oxides including Mg oxide dispersed in the copper alloy matrix are reduced in particle size to 3 μm or less, the resulting copper alloy sheet has a smaller decrease in spring limit value after bending than the conventional copper alloy sheet. Further, connectors formed of the copper alloy sheet show more excellent connecting strength than conventional connectors such that they will not be disconnected from their counterparts even under high temperature and vibrational conditions such as a location in the vicinity of an engine of an automotive vehicle.

The present invention is based upon the above finding, and the copper alloy sheet for connectors according to the invention has the aforesaid chemical composition.

To manufacture the copper alloy sheet for connectors according to the invention, first, electrolytic copper, a Cu—Mg mother alloy, and a Cu—P mother alloy are prepared as starting materials. Then, these starting materials are charged into a graphite crucible of an induction melting furnace and melted under a reducing atmosphere with the surface or meniscus of the molten alloy covered with a solid graphite material. Then, the chemical composition of the molten alloy thus obtained is adjusted so as for the resulting copper alloy sheet to have the aforesaid chemical composition. After the adjustment, the resulting molten alloy is cast into a graphite mold having a shallow cavity, by means of a graphite nozzle according to a semicontinuous casting method, to obtain a copper alloy ingot which has rather a small thickness. The obtained copper alloy ingot has fine crystal grains. The copper alloy ingot is then annealed at a temperature of 710° to 780° C. under a reducing atmosphere, and then hot rolled, followed by water cooling and scalping. Further, the scalped ingot is repeatedly subjected to cold rolling at a rate of 40 to 80% and continuous annealing at a temperature of 350° to 550° C., followed by final cold rolling and annealing at a temperature of 250° to 400° C. for relieving strain, etc., to thereby obtain a copper alloy sheet.

The chemical composition and structure of the Cu alloy sheet for connectors according to the invention have been limited as stated before, for the following reasons:

A. Chemical Composition (a) Magnesium (Mg)

The Mg component is solid-solved into the Cu matrix to improve the strength and the high-temperature creep strength without spoiling the electric conductivity. However, if the Mg content is less than 0.3%, the above action cannot be performed to a desired extent, whereas if the Mg content exceeds 2%, particles of oxides including Mg oxide in the ingot can easily grow to particle sizes larger than 3 μm, and further the electric conductivity can be degraded. Therefore, the Mg content has been limited to the range of 0.3 to 2%, and preferably to a range of 0.3 to 1.2%.

(b) Phosphorus (P)

The P component exhibits a deoxidizing action, and acts, in cooperation with the Mg component, to improve the strength and the high-temperature creep strength. However, if the P content is less than 0.001%, the above actions cannot be performed to a desired extent. On the other hand, if the P content exceeds 0.02%, oxide particles grow to excessive particle sizes. Therefore, the P content has been limited to the range of 0.001 to 0.02%, and preferably to a range of 0.03 to 0.012%.

(c) Carbon (C)

Carbon is very difficult to solid solve into pure copper. If a trace of carbon is contained in the Cu matrix, however, the carbon component acts to restrain oxides including Mg oxide from growing larger in size. However, if the carbon content is less than 0.0002%, the above action cannot be performed to a desired extent. On the other hand, if the carbon content exceeds 0.0013%, carbon is contained in an amount exceeding the solid-soluble limit to be precipitated at grain boundaries of the copper alloy sheet material for connectors, which causes intercrystalline cracks in the alloy sheet material and hence embrittle the same. As a result, the sheet can suffer from cracking during bending. Therefore, the carbon content has been limited to the range from 0.0002 to 0.0013%, and preferably to a range from 0.0003 to 0.0010%.

(d) Oxygen (O)

The oxygen component forms an oxide by reaction with the Mg component in the copper alloy. If the oxide has fine particles and is contained in a very small amount, it is effective for reducing the wear of the blanking die. However, if the oxygen content is less than 0.0002%, the above action cannot be performed to a desired extent, whereas if the oxygen content exceeds 0.001%, oxides including Mg oxide grow larger than a desired particle size. Therefore, the oxygen content has been limited to the range from 0.0002 to 0.001%, and preferably to a range from 0.0003 to 0.0008%.

B. Structure (e) Oxides including Mg oxide

Fine particles of oxides including Mg oxide dispersed in the matrix of the copper alloy sheet for connectors act to improve the springiness of the copper alloy sheet after bending, as well as the high-temperature creep strength. It is preferable that the particle size of the oxides including Mg oxide is as small as possible. If the particle size exceeds 3 μm, the springiness of the copper alloy sheet after bending is degraded. Therefore, the particle size of the oxides including Mg oxide dispersed in the matrix of the copper alloy sheet has been limited to the range of 3 μm or less.

Examples of the invention will now be described hereinbelow.

EXAMPLE 1

Electrolytic copper, a Cu—Mg mother alloy, and a Cu—P mother alloy were prepared as starting materials. First, the electrolytic copper was melted in a graphite crucible of a coreless type induction melting furnace under an atmosphere of a mixture gas of CO and $N_2$ with the surface of the molten alloy covered with a solid graphite material. Then, the Cu—P mother alloy was added to the molten alloy to deoxidize it, and further the Cu—Mg mother alloy was added to the deoxidized molten alloy to adjust the chemical composition of the molten alloy. The resulting molten alloy was cast into a graphite mold by means of a graphite nozzle, to obtain an ingot having a size of 100 mm in thickness, 400 mm in width, and 1500 mm in length. Thus, copper alloy ingots with rather a small thickness, having chemical compositions shown in Table 1, were prepared.

These copper alloy ingots were hot-rolled at a temperature of 750° C., into hot-rolled plates having a thickness of 11 mm. Then, the thus prepared hot-rolled plates were water-cooled, followed by scalping upper and lower side surfaces thereof by 0.5 mm, to thereby reduce the thickness to 10 mm. Further, the resulting plates were repeatedly subjected to cold rolling at a rate of 60 to 70% and continuous annealing at an actual material temperature of 450° C., followed by final cold rolling at a final rate of 75%, to thereby obtain cold-rolled sheets with a thickness of 0.20 mm. Finally, the thus obtained cold-rolled sheets were subjected to continuous annealing for relieving strain at a temperature of 330° C., to thereby obtain copper alloy sheets Nos. 1 to 9 for connectors according to the present invention (hereinafter referred to as "the sheets according to the present invention"), comparative copper alloy sheets for connectors Nos. 1 and 2 (hereinafter referred to as "the comparative sheets"), and a conventional copper alloy sheet for connectors (hereinafter referred to as "the conventional sheet").

The thus obtained sheets Nos. 1 to 9 according to the present invention, the comparative sheets Nos. 1 and 2, and the conventional sheet were each examined at 10 portions thereof by means of a scanning electron microscope at a 2500×magnification, to measure the size of particles of precipitated oxides including Mg oxide showing the maximum particle size of the particles at the examined portions. The results are shown in Table 1.

Next, to evaluate the strength, the sheets Nos. 1 to 9 according to the present invention, the comparative sheets Nos. 1 and 2, and the conventional sheet were measured as to the tensile strength, elongation, and spring limit value before bending (by a bending moment test according to JIS H3130). Further, to evaluate the electric conductivity and high-temperature creep strength, the stress relaxation ratio of the sheets was measured. Then, the decrease ratio of the spring limit value after bending was measured. The results are shown in Table 2.

TABLE 1

| SPECIMEN | CHEMICAL COMPOSITION (wt %) Mg | P | C | O2 | Cu & INEVITABLE IMPURITIES | STRUCTURE PARTICLE SIZE OF OXIDES INCLUDING Mg OXIDE (μm) |
|---|---|---|---|---|---|---|
| SHEETS ACCORDING TO PRESENT INVENTION | | | | | | |
| 1 | 0.72 | 0.015 | 0.0002 | 0.0008 | BALANCE | 2.6 |
| 2 | 0.64 | 0.007 | 0.0005 | 0.0006 | BALANCE | 1.1 |
| 3 | 0.67 | 0.005 | 0.0008 | 0.0005 | BALANCE | 0.2 |
| 4 | 0.53 | 0.008 | 0.0010 | 0.0007 | BALANCE | 0.2 |
| 5 | 0.66 | 0.004 | 0.0012 | 0.0006 | BALANCE | 0.1 |
| 6 | 0.78 | 0.006 | 0.0004 | 0.0002 | BALANCE | 0.4 |
| 7 | 0.66 | 0.005 | 0.0005 | 0.0004 | BALANCE | 0.3 |
| 8 | 0.50 | 0.007 | 0.0003 | 0.0007 | BALANCE | 1.0 |
| 9 | 0.65 | 0.009 | 0.0003 | 0.0009 | BALANCE | 1.9 |
| COMPARATIVE SHEETS | | | | | | |
| 1 | 0.71 | 0.007 | 0.0016* | 0.0009 | BALANCE | 0.4 |
| 2 | 0.70 | 0.008 | 0.0004 | 0.0015* | BALANCE | 4.5* |
| CONVENTIONAL SHEET | 0.68 | 0.032* | —* | 0.0011* | BALANCE | 7.0 |

NOTE: The asterisked value falls outside the range according to the present invention.

TABLE 2

| SPECIMEN | TENSILE STRENGTH ($N/mm^2$) | ELONGATION (%) | ELECTRIC CONDUCTIVITY (IACS %) | SPRING LIMIT VALUE BEFORE BENDING ($N/mm^2$) | DECREASE RATIO OF SPRING LIMIT VALUE AFTER BENDING (%) | STRESS RELAXATION RATIO (%) |
|---|---|---|---|---|---|---|
| SHEETS ACCORDING TO PRESENT INVENTION | | | | | | |
| 1 | 580 | 10 | 63 | 440 | 33 | 15 |
| 2 | 560 | 9 | 68 | 415 | 29 | 13 |
| 3 | 570 | 9 | 66 | 430 | 27 | 12 |
| 4 | 555 | 7 | 69 | 410 | 30 | 14 |
| 5 | 565 | 7 | 67 | 420 | 32 | 11 |
| 6 | 590 | 8 | 60 | 455 | 27 | 11 |
| 7 | 560 | 10 | 66 | 420 | 27 | 13 |
| 8 | 550 | 9 | 70 | 405 | 29 | 15 |
| 9 | 565 | 9 | 67 | 425 | 31 | 14 |

TABLE 2-continued

| SPECIMEN | TENSILE STRENGTH ($N/mm^2$) | ELONGATION (%) | ELECTRIC CONDUCTIVITY (IACS %) | SPRING LIMIT VALUE BEFORE BENDING ($N/mm^2$) | DECREASE RATIO OF SPRING LIMIT VALUE AFTER BENDING (%) | STRESS RELAXATION RATIO (%) |
|---|---|---|---|---|---|---|
| COMPARATIVE SHEETS | | | | | | |
| 1 | 580 | 4 | 63 | 435 | 40 | 12 |
| 2 | 575 | 9 | 64 | 440 | 43 | 24 |
| CONVENTIONAL SHEET | 570 | 8 | 65 | 420 | 50 | 27 |

The stress relaxation ratio for evaluating the high-temperature creep strength was measured as follows: Test pieces having a size of 12.7 mm in width and 120 mm in length (hereinafter referred to as "$L_0$") were prepared. The test pieces were each set into a jig which is formed therein with a horizontal elongate groove having a size of 110 mm in length and 3 mm in depth, in a fashion that the test piece was curved with a central portion thereof upwardly bulged (the distance between the both ends of the test piece thus set, i.e. 110 mm, is represented by "$L_1$"). The test piece was soaked in the set state at a temperature of 170° C. for 1000 hours, and then the test pieces was removed from the jig and the distance between the both ends of the test piece was measured. The stress relaxation ratio was calculated by the use of the following equation:

$$\text{Stress Relaxation Ratio}=(L_0-L_2)/(L_0-L_1)\times 100\%$$

The decrease ratio of the spring limit value after bending was measured as follows: Test pieces 1 for a bending test, shown in FIG. 1, were, prepared by bending pieces of the copper alloy sheet into a shape having a bend radius: 0 mm, a bending angle A: 130°, and an offset B: 2 mm. Then, the spring limit value after bending was measured by the bending moment test according to JIS H3130, by the use of the thus prepared bent test pieces 1. The thus measured spring limit value after bending and the spring limit value before bending, which had been measured beforehand, were substituted into the following equation, to thereby calculate the decrease ratio of the spring limit value after bending:

$$\text{Decrease Ratio (\%)} = (\text{Spring limit value before bending} - \text{Spring limit value after bending})/(\text{Spring limit value before bending}) \times 100$$

As is clear from the results shown in Tables 1 and 2, the sheets Nos. 1 to 9 according to the present invention all exhibit as good tensile strength, elongation, electric conductivity, and spring limit value at the ordinary temperature as those of the conventional sheet. Further, the sheets according to the present invention show values of the decrease ratio of the spring limit value after forming which are less than 35%, and further are excellent in stress relaxation ratio, as well. On the other hand, the comparative sheet No. 1 which contains more than 0.0013% carbon, and the comparative sheet No. 2 which contains more than 0.001% oxygen and hence particles of oxides including Mg oxide thereof have a particle size in excess of 3 μm undesirably show large values of the decrease ratio of the spring limit value after forming, which does not satisfy requirements for forming connectors.

EXAMPLE 2

Figure 2:
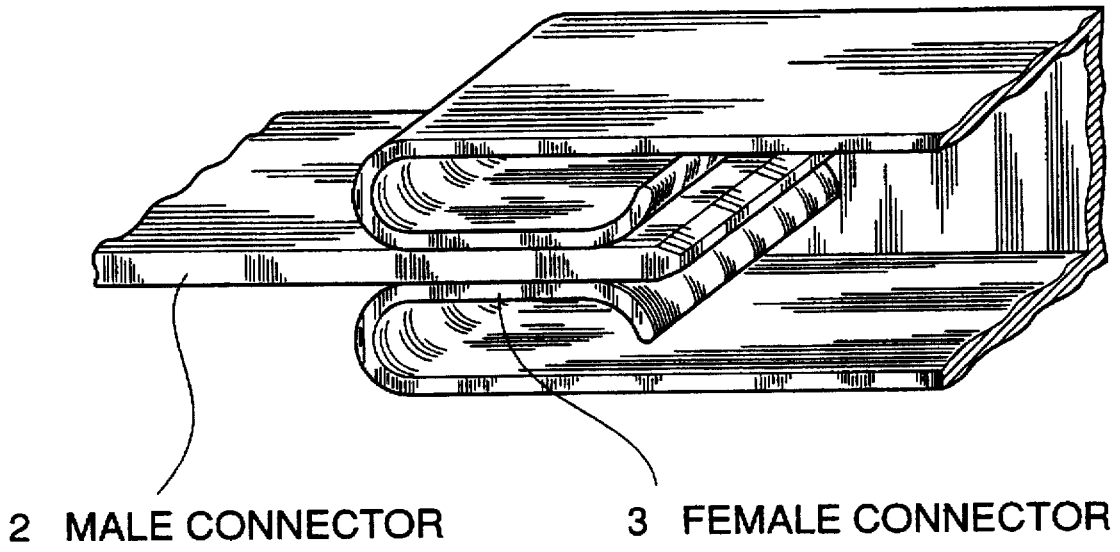
FIG. 2 is a perspective view showing a male connector and a female connector, which is useful in explaining how to measure the gripping force of the connectors.

The sheets Nos. 1 to 9 according to the present invention, the comparative sheets 1 and 2, and the conventional sheet obtained in Example 1 were each formed into a U-shaped form shown in FIG. 2. Each of the formed sheets had end portions thereof cut, followed by bending uncut end portions thereof, to thereby form a female connector 3 shown in FIG. 2. Further, the sheets Nos. 1 to 9 according to the present invention, the comparative sheets Nos. 1 and 2, and the conventional sheet obtained in Example 1 were stamped by ordinary stamping to form a male connector 2 shown in FIG. 2. Thus, connectors Nos. 1 to 9 according to the present invention, comparative connectors 1 and 2, and a conventional connector were prepared, which each consist of the male connector 2 and the female connector 3. The male connector 2 of each of the connectors Nos. 1 to 9 according to the present invention, the comparative connectors Nos. 1 and 2, and the conventional connector was inserted into the female connector 3 of each of the connectors at the ordinary temperature, and soaked in the air for 24 hours. Then, a pull-out load required to pull the male connector out of the female connector was measured. The results of the measurement are shown in Table 3, as a gripping force $W_0$ of the female connectors at the ordinary temperature.

Next, the male connector 2 of each of the connectors 1 to 9 according to the present invention, the comparative connectors Nos. 1 and 2, and the conventional connector was inserted into the female connector 3, and the connectors 2 and 3 thus coupled together were vacuum-sealed in a Pilex glass tube, the interior of which was held in a vacuum of $3\times10^{-3}$ mmHg. The Pilex glass tube containing the connectors 2 and 3 was annealed in an electric furnace at a temperature of 170° C. for 1000 hours, and then cooled to the ordinary temperature. Then, the connectors 2 and 3 were taken out of the Pilex glass tube, and a pull-out load $W_1$ required to pull the male connector 2 out of the female connector 3 was measured. The results of the measurement are shown in Table 3, as a gripping force $W_1$ of the female connectors after soaking at high temperature.

A decrease ratio of gripping force due to soaking of the connectors at high temperature was calculated, based on the thus measured gripping forces $W_0$ and $W_1$, by the use of the following equation:

$$\text{Decrease Ratio of Gripping Force}=(W0-W1)/W0\times 100\%$$

The results are shown in Table 3.

As is clear from the results in Table 3, the connectors Nos. 1 to 9 formed of the copper alloy sheets Nos. 1 to 9 according to the present invention show smaller values of the decrease ratio of gripping force than those of the comparative connectors Nos. 1 and 2 formed of the comparative copper alloy sheets 1 and 2 and the conventional connector formed of the conventional sheet.

As described above in detail, the copper alloy sheet for connectors according to the present invention shows a smaller decrease ratio of the spring limit value after bending than that of the conventional copper alloy sheet, while possessing as good tensile strength, elongation, spring limit value before bending, high-temperature creep strength, and electric conductivity as those of the conventional copper alloy sheets. As a result, connectors formed of the copper alloy sheet according to the present invention show a smaller decrease ratio of the gripping force. Therefore, the connectors according to the present invention can be used under severe high-temperature conditions such as a location in the vicinity of an engine of an automotive vehicle, without trouble, such as disconnection of the connectors, providing excellent effects which are useful industrially.

TABLE 3

| CONNECTORS | EMPLOYED SHEETS | GRIPPING FORCE $W_0$ AT ORDINARY TEMP. (g) | GRIPPING FORCE $W_1$ AT ORDINARY TEMP. AFTER SOAKING AT HIGH TEMP. (g) | DECREASING RATIO OF GRIPPING FORCE (%) |
|---|---|---|---|---|
| CONNECTORS ACCORDING TO PRESENT INVENTION | SHEETS ACCORDING TO PRESENT INVENTION | | | |
| 1 | 1 | 192 | 146 | 24 |
| 2 | 2 | 195 | 154 | 21 |
| 3 | 3 | 204 | 165 | 19 |
| 4 | 4 | 192 | 150 | 22 |
| 5 | 5 | 189 | 156 | 17 |
| 6 | 6 | 216 | 179 | 17 |
| 7 | 7 | 203 | 160 | 21 |
| 8 | 8 | 193 | 147 | 24 |
| 9 | 9 | 190 | 149 | 22 |
| COMPARATIVE CONNECTORS | COMPARATIVE SHEETS | | | |
| 1 | 1 | 162 | 105 | 35 |
| 2 | 2 | 158 | 96 | 39 |
| CONVENTIONAL CONNECTORS | CONVENTIONAL SHEETS | 137 | 78 | 43 |

What is claimed is:

1. A copper alloy sheet for connectors, having a chemical composition consisting essentially of:

Mg: 0.3–2% by weight;

P: 0.001–0.02% by weight;

C: 0.0002–0.0013% by weight;

O: 0.0002–0.001% by weight; and

Cu and inevitable impurities: the balance;

said copper alloy sheet having a structure that fine particles of oxides including Mg oxide having a particle size of not more than 3 μm are evenly dispersed in a matrix of said copper alloy sheet.

2. A copper alloy sheet as claimed in claim 1, having a chemical composition consisting essentially of:

Mg: 0.3–1.2% by weight;

P: 0.003–0.012% by weight;

C: 0.0003–0.0010% by weight;

O: 0.0003–0.0008% by weight; and

Cu and inevitable impurities: the balance.

3. A connector formed of a copper alloy sheet having a chemical composition consisting essentially of:

Mg: 0.3–2% by weight;

P: 0.001–0.02% by weight;

C: 0.0002–0.0013% by weight;

O: 0.0002–0.001% by weight; and

Cu and inevitable impurities: the balance;

said copper alloy sheet having a structure that fine particles of oxides including Mg oxide having a particle size of not more than 3 μm are evenly dispersed in a matrix of said copper alloy sheet.

4. A connector as claimed in claim 3, wherein said copper alloy sheet has a chemical composition consisting essentially of:

Mg: 0.3–1.2% by weight;

P: 0.003–0.012% by weight;

C: 0.0003–0.0010% by weight;

O: 0.0003–0.0008% by weight; and

CU and inevitable impurities: the balance.

* * * * *